United States Patent [19]

Hasegawa

[11] 4,263,948

[45] Apr. 28, 1981

[54] VENEER LATHE

[75] Inventor: Katsuji Hasegawa, Nagoya, Japan

[73] Assignee: Meinan Machinery Works, Inc., Ohbu, Japan

[21] Appl. No.: 20,845

[22] Filed: Mar. 15, 1979

[51] Int. Cl.[3] ..... B27L 5/02

[52] U.S. Cl. ..... 144/213; 144/209 R

[58] Field of Search ..... 144/162 R, 209 R, 211, 144/212, 213, 215, 323

[56] References Cited

U.S. PATENT DOCUMENTS 3,207,194 9/1965 Heberg et al. ..... 144/213

*Primary Examiner*—W. Donald Bray

*Attorney, Agent, or Firm*—Armstrong, Nikaido, Marmelstein & Kubovcik

[57] ABSTRACT

A veneer lathe including drive rolls capable of being adjusted horizontally and vertically with the advance of the cutting operation. As the log diameter decreases, drive roll spike pressure and depth are adjusted, thus avoiding veneer damage and improving veneer quality.

6 Claims, 6 Drawing Figures

VENEER LATHE

BACKGROUND OF THE INVENTION

The present invention relates to a veneer lathe which includes drive rolls provided ahead of the knife. More particularly, the present invention relates to a veneer lathe which includes drive rolls, capable of being adjusted horizontally and vertically.

Conventionally, a veneer lathe having drive rolls provided for exerting external force onto the log surface ahead of the tangential knife in order to reduce load on the log core is known. (See U.S. patent application Ser. No. 861,278). The drive rolls carry a plurality of spikes around their periphery. These spikes cut into the log surface and rotate the log as the rolls are driven by a motor.

As the cutting operation advances, however, the quality of the log wood into which the spikes cut becomes progressively poorer. As a result, such spike engagement can mar the surface quality since the wood cannot withstand the spike forces.

In addition, other problems are found in the conventional veneer lathe as the log diameter decreases with the advance of cutting operation. First, the depth of spike cuts into the log wood becomes smaller. Second, the number of those spikes engaging decreases. Third, the pressure exerted on the log surface ahead of the knife edge by the pressure bars and pressure rollers, decreases. Referring to FIG. 1, circle A represents a large diameter log, circle B a small diameter log, and circle C a drive roll or a pressure roller. The spike piercing depth, the number of piercing spikes, and the pressure exerted on the log wood ahead of the knife edge at the initial stage of the cutting operation are represented by area D defined by the intersection of circles A and circle C. Later stage conditions are represented by area E defined by the intersection of circle B and circle C. As shown, area E is smaller than area D. This area represents detrimental phenomena observed in a conventional veneer lathe.

SUMMARY OF THE INVENTION

In order to solve the foregoing problems, there is provided a veneer lathe which is provided, in addition to the conventional structure, with regulator means for adjusting the position of a unitary structure including the drive rolls and the pressure members as the cutting operation advances.

BRIEF DESCRIPTION OF THE DRAWINGS

Other objects and aspects of the invention will become apparent from the following description of embodiments with reference to the accompanying drawings in which.

DETAILED DESCRIPTION OF THE EMBODIMENTS

Figure 1:
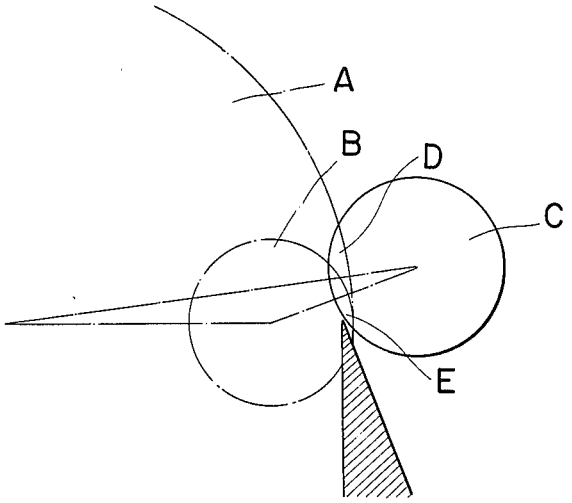
FIG. 1 is a diagrammatic illustration of the detrimental phenomena observed in the cutting operation of a log turned on a conventional veneer lathe.
Figure 2:
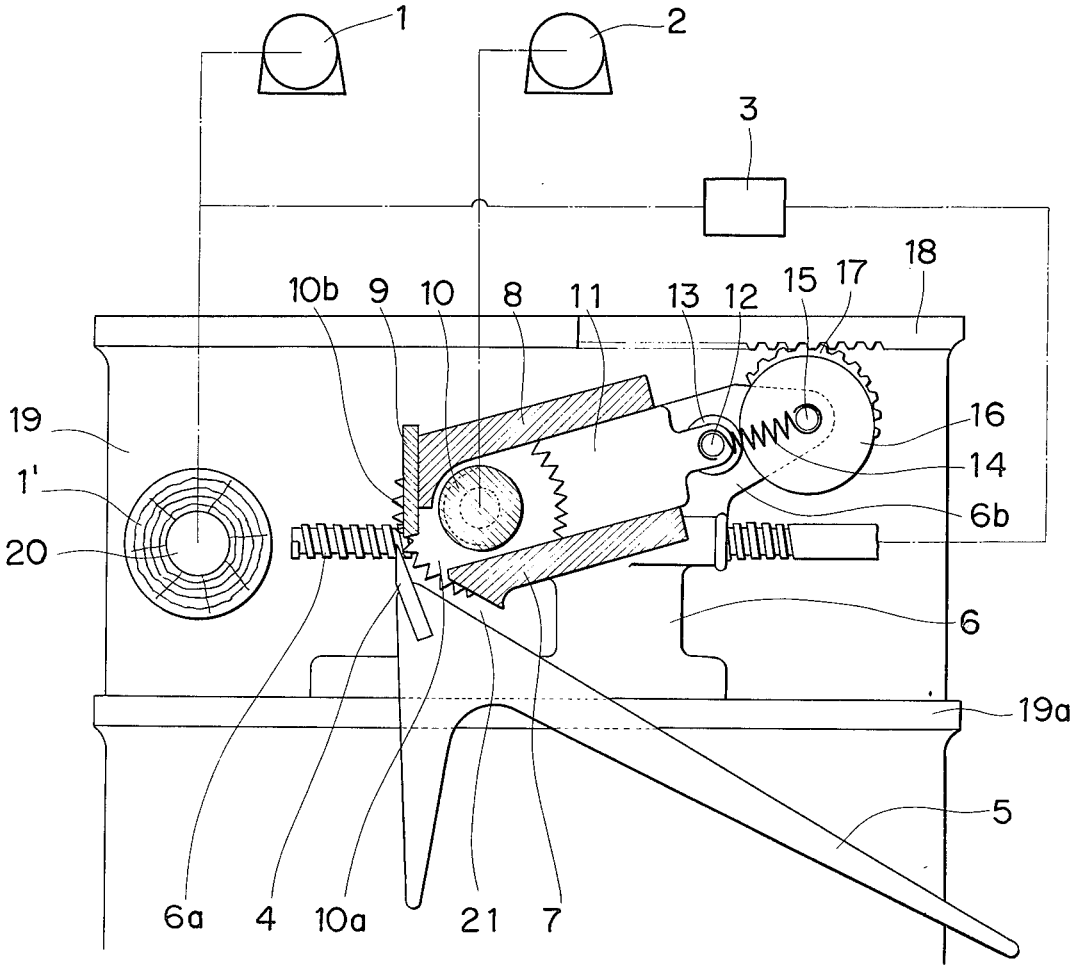
FIG. 2 is a side sectional view of one embodiment of the present invention.

Referring to FIG. 2, one embodiment of the present invention is explained. Knife 4 is mounted on knife holder 5 by means of conventional clamping devices. Both ends of knife holder 5 are fixed to travelling table 6. The veneer lathe is further provided with known devices such as frame 19, slide rails **19*a* rigidly attached to frame 19, spindle 20 for rotating log 1' and lead screw 6*a* for feeding travelling table 6. Drive roll 10 having a diameter of about 135 mm. carries a plurality of spikes 10*b* on its surface. The spikes are aligned in parallel rows around the surface with a pitch of about 10 mm. Between each two adjacent rows, recesses 10*a* of about 25 mm. wide are formed around the surface with a spacing of about 30 mm. therebetween. The axis of the drive roll is set at a level about 17 mm. above the knife edge so that working spikes 10*b* are disposed near knife 4. The upper pressure board 8 and lower pressure board 7 are provided as integral portions of the travelling table 6 above knife holder 5 and veneer path 21 with an inclination of about 12 degrees. Roll holder 11 which supports the drive roll 10 at its both axial ends is held slidably between the upper and lower pressure boards 8 and 7. Fixed pressure bar 9 is provided with divided sections which are positioned in recesses 10*a* of drive roll 10. Drive roll 10 is driven by motor 2** through a transmission (not shown).

For a log having an irregular form, however, motor 1 is needed for driving log spindle 20 through a transmission (not shown) since spikes **10*b* will not always uniformly contact the log surface. A gear box 3 is provided between spindle 20 and lead screw 6*a*, so that travelling table 6 is fed in proportion to the rotation of the log to obtain a sheet of veneer in an even thickness. For detecting a log diameter there are provided a rack 18 which is fixed to a stationary member such as the frame 19, and a pinion 17 which is rotatably attached to arm 6*b* of the travelling table 6 by means of pin 15. Pinion 17 engages with rack 18. For positioning roll 10, there is provided cam ball 13 which is rotatably fixed to roll holder 11 by means of pin 12, and cam 16 which is fixed to pin 15. A tension spring 14 connects pins 12 and 15, so that cam 15 and cam ball ball 13 are firmly contacted. Pinion 17 and cam 15 are connected through pin 15. Accordingly, the rotation of cam 15 is directly transmitted from pinion 17**.

The veneer lathe constructed as described above operates as follows. Spindle motor 1 drives spindle 20 which holds log 1'. Lead screw **6*a* is also rotated by the motor through transmission 3 in synthronization with the log rotation. Then, moving components, of knife holder 5, knife 4, upper pressure board 8, lower pressure board 7, fixed bar 9, roll holder 11, drive roller 10, pin 12, cam ball 13, tension sping 14, pin 15, cam 16, and pinion 17, which are attached directly or indirectly on the travelling table 6, are moved together toward the log. At the same time, drive roll 10 is rotated by motor 2. When cutting starts, the spikes 10*b* grip the log ahead of knife 4, forcing the log to be rotated with the aid of spindle 20 against the cutting resistance. During cutting operation the travelling table 6** moves forward, pinion 17 engaging with rack 18 rotates and then cam 16 also rotates. That is, travelling table 6 advances in accordance with the decrease of log diameter. The amount of advance is expressed in the form of the rotational angle of the pinion. Thus, the diameter of a log is detected, and this information is utilized through the action of to cam 16. The roll holder 11 is then moved toward knife 4 by cam ball 13 through the function of cam 16. Therefore the position of the drive roll 10 is controlled so that the number of spikes engaging the log surface is modified when the log diameter becomes smaller and a stable transmission of the force from the drive roll 10 to the log can be achieved.

Figure 4:
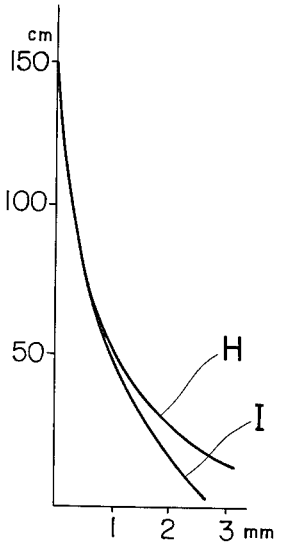
FIG. 4 is a graph showing the relationships between the log diameter and the amount of adjustment effected by the present invention.

FIG. 4 shows the relationships between the roll advance and the log diameter. The ordinate represents the log diameter, while the abscissa represents the amount of adjustment of the roll advance. Curve "H" represents the above relationships wherein roll holder 11 is adapted to thrust roll 10 by an increasing force with its advance toward the log so that spikes 10*b* pierce the log surface with a constant depth. On the other hand, as shown by curve "I", the depth of the thrust can be reduced as the log diameter becomes smaller because the core of a log has a smaller cutting resistance compared with a sapwood section. In this case, log bending due to the thrusting force when the log diameter is small, is alleviated while maintaining stable action of the driving force. Furthermore, in consideration of the tenderizing effect, which is an advantageous feature of a periphery-driving-type veneer lathe, spikes 10*b* of the drive roller 10 can be positioned so that they deeply grip a sapwood section where tenderizing is generally difficult. Thus, the roll positioning can easily be practised by designing cam 16 in accordance with the desired cutting condition.

Figure 3:
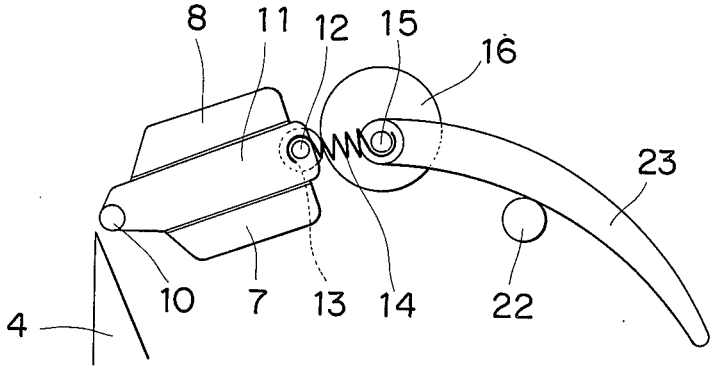
FIG. 3 is a diagrammatic side view of another embodiment of the present invention.

FIG. 3 shows another embodiment of this invention. A roller bar 24 (with a diameter of about 1 inch) is provided ahead of knife 4, being held by a roll holder 11 which is slidably supported between an upper pressure board 8*a* and a lower pressure board 7*a*. For positioning roll 10, a cam ball 13 is rotatably attached to the roller holder 11 by a pin 12, and cam 16 is fixed to a pin 15. For detecting a log diameter, a guide roller 22 is attached to a stationary member such as the frame of the lathe, so that it causes movement of arm 23. The moving arm 23 is fixed to the pin 15 so that the movement of arm 23 is transmitted to roll holder 11. A tension spring 14 connects the pins 12 and 15, so that the cam ball 13 and the cam 16 are firmly contacted. In such construction, the guide roller 22 is fixed to a stationary member and other components are held directly or indirectly by a moving member such as the travelling table (not shown). Thus, during cutting, the traveling table moves forward, and the moving arm 23 is guided to rotate counterclockwise by the guide roller 22. Then, the information of the log diameter is conveyed to the rotational angle of the cam 16 which can be designed in accordance with the cutting condition depending on the log diameter. The roll bar 4 presses the log surface closely before the cut position, so that a high quality veneer can be obtained. When the traveling table withdraws, the moving arm 23 rotates clockwise.

Figure 5:
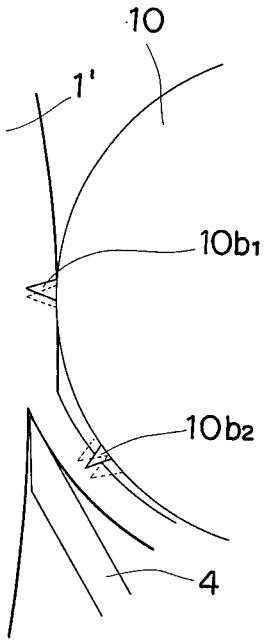
FIG. 5 is a diagrammatic illustration of the compression and deformation of the log wood created by a movement of spikes on the drive roll.
Figure 6:
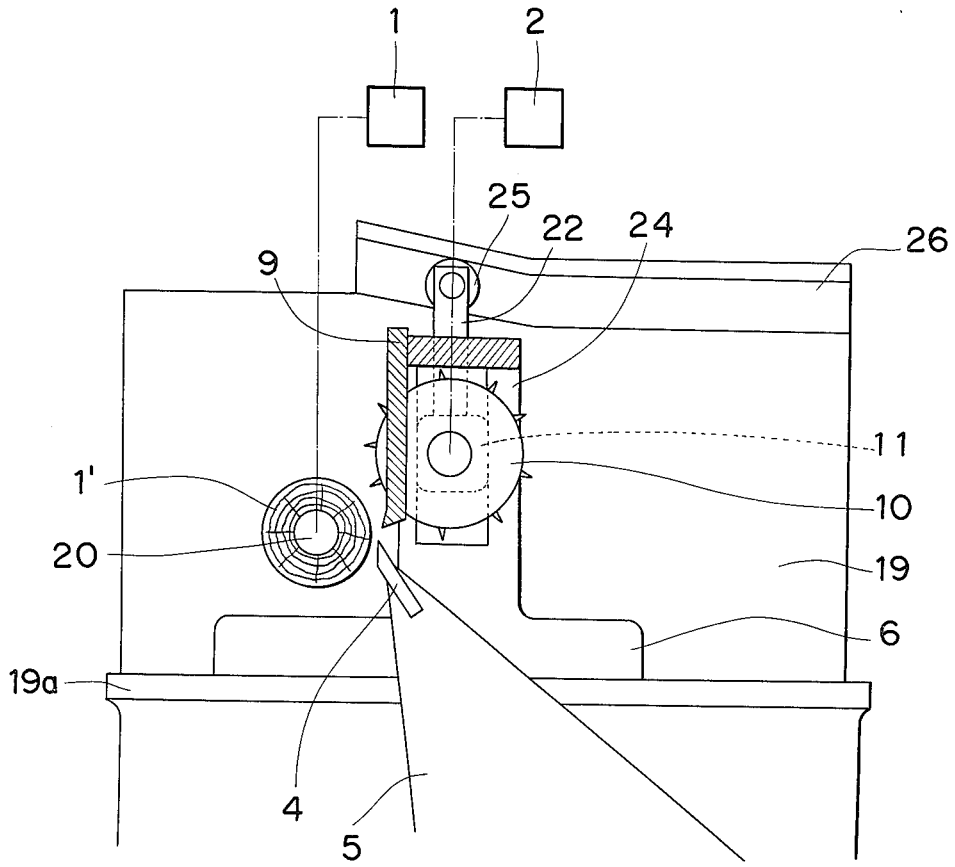
FIG. 6 is a diagrammatic side view of a further embodiment of the present invention.

A further embodiment of the present invention will be explained hereinafter referring to FIG. 5 and FIG. 6. In FIG. 5, it is shown that drive roll 10 carrying spikes $10b_1$ and $10b_2$ on the surface thereof drives log 1′ so that knife 4 cuts the log. As seen from the figure, spike $10b_1$ engages the log surface whereas spike $10b_2$ engages already cut veneer 1″.

In general, spike $10b_1$ which cuts into log 1′ compresses the wood in the direction of log rotation and deforms the wood during the cutting operation as shown by the spike depicted in dotted lines. As a result, tenderizing of the veneer can be achieved. As the operation advances, however, the amount of compression and deformation of the wood increases as the log core quality becomes poorer. As a result, spike $10b_2$ may cause veneer damage. Referring to FIG. 6, knife 4 is rigidly mounted on knife holder 5. The knife holder in turn is fixed onto travelling table 6 at its both sides. Travelling table 6 is adapted to slide, by means of lead screw (not shown), on slide rail 19*a* which is provided on both sides of knife holder 5. The travelling table supports thereon roller holder 11 which in turn rotatably supports drive roll 10. Roll holder 11 carries support 22 which in turn carries bearing 25. Above travelling table 6, there is provided vertical guide 24 which is adapted to guide roll holder 11 vertically. The upper portion of frame 19 is provided with horizontal guide 26. Said guide 26 is in the form of an inclined groove providing a suitable shape with which bearing 25 is engaged. As depicted, guide 26 is adapted to guide bearing 25 to a higher level as drive roll 10 approached the log.

The described embodiment includes only one drive roll 10. However, a plurality of drive rolls may be juxtaposed from one side of frame 19 to the other. In this arrangement, other members including roll holders, bearings, vertical guides are provided correspondingly. Further, nose bars 9 and nose bar support 9′ are disposed between these assemblies. Spindle 20 and drive roll 10 are driven by motors 1 and 2.

In operation, drive roll 10 is fed toward log 1′ with the advance of operation. Therefore, drive roll 10 is pulled upward since bearing 23 is guided to a high level. As a result, spikes 10*b* cut into only the log portion and veneer 13 is not subjected to external force to cause breakage.

What is claimed is:

1. A veneer lathe for cutting veneer from a log, which comprises:
   (a) support means for rotatably supporting said log;
   (b) a cutter means provided substantially at a tangent to the log surface;
   (c) a drive roll means adapted to contact the log slightly ahead of said cutter means for rotating the log;
   (d) feeding means for feeding said cutter means and said drive roll means to the log in accordance with its decreasing diameter, said cutter means and said drive roll means being mounted on said feeding means and said feeding means being mounted on said support means;
   (e) sensor means for detecting the log diameter being mounted interconnectingly between said feeding means and said support means; and
   (f) regulator means for adjusting a position of the drive roll means operatively associated with said sensor means and said drive roll means and being mounted on said feeding means.

2. A veneer lathe according to claim 1, further comprising said support means comprises a frame rigidly provided in association with the log; and said regulator means comprising a drive roll holder adapted to rotatably support the drive roll means, guide means for guiding said drive roll holder in the direction of the log mounted on said feeding means, and cam means disposed between the sensor means and the drive roll holder for adjusting the position of drive roller means horizontally relative to the log.

3. A veneer lathe according to claim 2, wherein said sensor means includes a rack and pinion assembly provided in association with the frame.

4. A veneer lathe according to claim 2, wherein said sensor means includes an arm member pivotally attached at its one end to said cam means and a support roll rigidly attached to the frame and adapted to slidably support the arm member such that said arm actuates the regulator means.

5. A veneer lathe for cutting a veneer lathe from a log, which comprises:

(a) support means for rotatably supporting said log;

(b) a cutter means provided substantially at a tangent to the log surface;

(c) a drive roll means adapted to contact the log slightly ahead of said cutter means for rotating the log;

(d) feeding means for feeding said cutter means and said drive roll means toward the log in accordance with decreasing diameter, said cutter means and said drive roll means being mounted on said feeding means, and said feeding means being mounted on said support means, said drive roll means being adjustable relative to said cutter means; and (e) regulator means for adjusting the position of the drive roll means relative to said cutter means interconnectingly operatively associated with said drive roll means and said feeding means.

6. A veneer lathe according to claim 5, wherein said regulator means includes a guide means for raising said drive roll means progressively toward the log.

* * * * *